US011034180B2

(12) United States Patent
Ueno et al.

(10) Patent No.: US 11,034,180 B2
(45) Date of Patent: Jun. 15, 2021

(54) STAPLING APPARATUS AND METHOD OF CONTROLLING STAPLING APPARATUS

(71) Applicant: SEIKO EPSON CORPORATION, Tokyo (JP)

(72) Inventors: Kohei Ueno, Matsumoto (JP); Nobuyuki Mizushima, Shiojiri (JP); Yutaro Harada, Shiojiri (JP); Shunpei Yamaguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 41 days.

(21) Appl. No.: 16/693,891

(22) Filed: Nov. 25, 2019

(65) Prior Publication Data

US 2020/0171872 A1 Jun. 4, 2020

(30) Foreign Application Priority Data

Nov. 30, 2018 (JP) ..... JP2018-225674

(51) Int. Cl.

| | |
|---|---|
| ***B42C 1/12*** | (2006.01) |
| ***B41L 43/12*** | (2006.01) |
| ***B65H 37/06*** | (2006.01) |
| ***B65H 37/04*** | (2006.01) |
| *B27F 7/19* | (2006.01) |
| *B42C 3/00* | (2006.01) |

(52) U.S. Cl.

CPC ..... *B42C 1/12* (2013.01); *B41L 43/12* (2013.01); *B65H 37/04* (2013.01); *B65H 37/06* (2013.01); *B27F 7/19* (2013.01); *B42C 3/00* (2013.01)

(58) Field of Classification Search

CPC ..... B41L 43/06; B41L 43/12; B65H 37/04; B65H 37/06; B42C 1/12

USPC ..... 270/37, 58.08

See application file for complete search history.

(56) References Cited

U.S. PATENT DOCUMENTS

| | | | | |
|---|---|---|---|---|
| 6,217,016 | B1 * | 4/2001 | Honmochi | B42C 1/12 270/37 |
| 7,871,065 | B2 * | 1/2011 | Fukasawa | B65H 45/18 270/37 |
| 8,317,179 | B2 * | 11/2012 | Takata | B42C 1/12 270/37 |

(Continued)

FOREIGN PATENT DOCUMENTS

| | | |
|---|---|---|
| CN | 108529269 | 9/2018 |
| JP | H08-192951 | 7/1996 |
| JP | 2010-001149 A | 1/2010 |

*Primary Examiner* — Leslie A Nicholson, III

(74) *Attorney, Agent, or Firm* — Workman Nydegger

(57) ABSTRACT

A stapling apparatus including a holding portion that receives and holds a plurality of mediums, a first matching portion positioned downstream of the holding portion, a paddle that applies sending force to the mediums so that leading edge sides of the mediums reach the first matching portion, a stapler that binds the mediums, the leading edge sides of the mediums having been matched by the first matching portion, a folding mechanism portion that folds the mediums that have been bound by the stapler. In the stapling apparatus, the first matching portion is configured to move and is configured to transport the mediums to a performing position of the stapler and a performing position of the folding mechanism portion by moving, and a position where the paddle applies sending force to the mediums differs according to lengths of the mediums in a transport direction.

13 Claims, 16 Drawing Sheets

(56) References Cited

U.S. PATENT DOCUMENTS

| | | | | |
|---|---|---|---|---|
| 9,302,879 | B2 * | 4/2016 | Matsumoto | G03G 15/6582 |
| 2018/0251331 | A1 | 9/2018 | Nakano | |

* cited by examiner

STAPLING APPARATUS AND METHOD OF CONTROLLING STAPLING APPARATUS

The present application is based on, and claims priority from JP Application Serial Number 2018-225674, filed Nov. 30, 2018, the disclosure of which is hereby incorporated by reference herein in its entirety.

BACKGROUND

1. Technical Field

The present technique relates to a stapling apparatus that performs processes on mediums.

2. Related Art

In a stapling apparatus that performs processes on mediums, the processes performed on the mediums are performed on a stack of mediums. A stack of mediums is formed by matching an end of a medium sent from a portion upstream in a medium transport direction with ends of other mediums and stacking the mediums on a holding portion. Matching the medium and other mediums to each other is performed basically by abutting the medium that has been transported from an upstream portion against a matching portion and stacking the medium on the other mediums. In so doing, the movement of the medium from the upstream portion to the matching portion is basically created by inertial movement and gravitational force of the medium. Accordingly, in some cases, depending on the length of the medium, the medium may be stuck midway in the path and may not reach the matching portion. A problem such as the medium not being matched with the other mediums occur due to the above. In order to overcome the above problem, a known stapling apparatus has been proposed that is provided with a function that enables the medium to reach the matching portion so that the medium is matched with the other mediums (JP-A-2010-001149, for example).

JP-A-2010-001149 describes a sheet processing apparatus having a structure provided with a paddle that rotates vanes about a rotation shaft and that promotes matching of end portions of mediums (a stack of sheets) provided in a lower portion of a holding portion (an intermediate tray) that stores the mediums (the stack of sheets) sent by feed rollers (a mechanism that sends the medium). The structure matches and aligns the end portions of the mediums (the stack of sheets) with a matching portion (an end guide) at a lower portion of the holding portion (the intermediate tray).

However, in such a structure, since the paddle is located on the lower side of the holding portion (the intermediate tray), the medium, which has been sent out through the feed rollers and in which no sending force acts thereon any more, may be stuck inside a transport path at a position before the leading edge of the medium reaches the paddle.

Furthermore, when the sheet processing apparatus is configured to have a structure in which the paddle is disposed on an upper side with respect to the position on the lower side of the holding portion (the intermediate tray) to reduce states in which the sending force does not act on the medium, the following incidents may occur.

When the rotating speed of the rotating paddle is set slow and the sending speed of the medium created by the paddle is slower than the sending speed of the feed rollers located upstream of the paddle in the transport path, the medium may become buckled at a portion between the feed rollers and the paddle, and the transport path of the medium sent next may become narrow.

Conversely, when the rotating speed of the paddle is set fast, when the leading edge of the medium abuts against the matching portion, bulging and deforming may occur in the medium at a portion between the leading edge and the paddle, and the transport path of the medium sent next may become narrow. Furthermore, the sending speed of the paddle may become excessively fast after the trailing edge of the medium is separated from the feed rollers, and due to the impact when the leading edge (a lower edge) of the medium reaches and abuts against the matching portion in the lower portion of the holding portion (the intermediate tray), the medium may jump up.

That is to say, with the known paddle structure, the leading edge of the medium may not reach the matching portion in the lower portion of the holding portion, or the medium may jump up and may not be able to be matched with the other mediums.

SUMMARY

A stapling apparatus overcoming the above issue includes a holding portion that receives, stacks, and holds a plurality of mediums transported thereto, a first matching portion positioned downstream of the holding portion in a transport direction, a paddle that applies sending force to the mediums so that leading edge sides of the mediums reach the first matching portion, a stapler that binds the mediums, the leading edge sides of the mediums having been matched by the first matching portion, a folding mechanism portion that folds the mediums that have been bound by the stapler. In the stapling apparatus, the first matching portion is configured to move and is configured to transport the mediums to a performing position of the stapler and a performing position of the folding mechanism portion by moving, and a position where the paddle applies sending force to the mediums differs according to lengths of the mediums in the transport direction.

DESCRIPTION OF EXEMPLARY EMBODIMENTS

Figure 1:
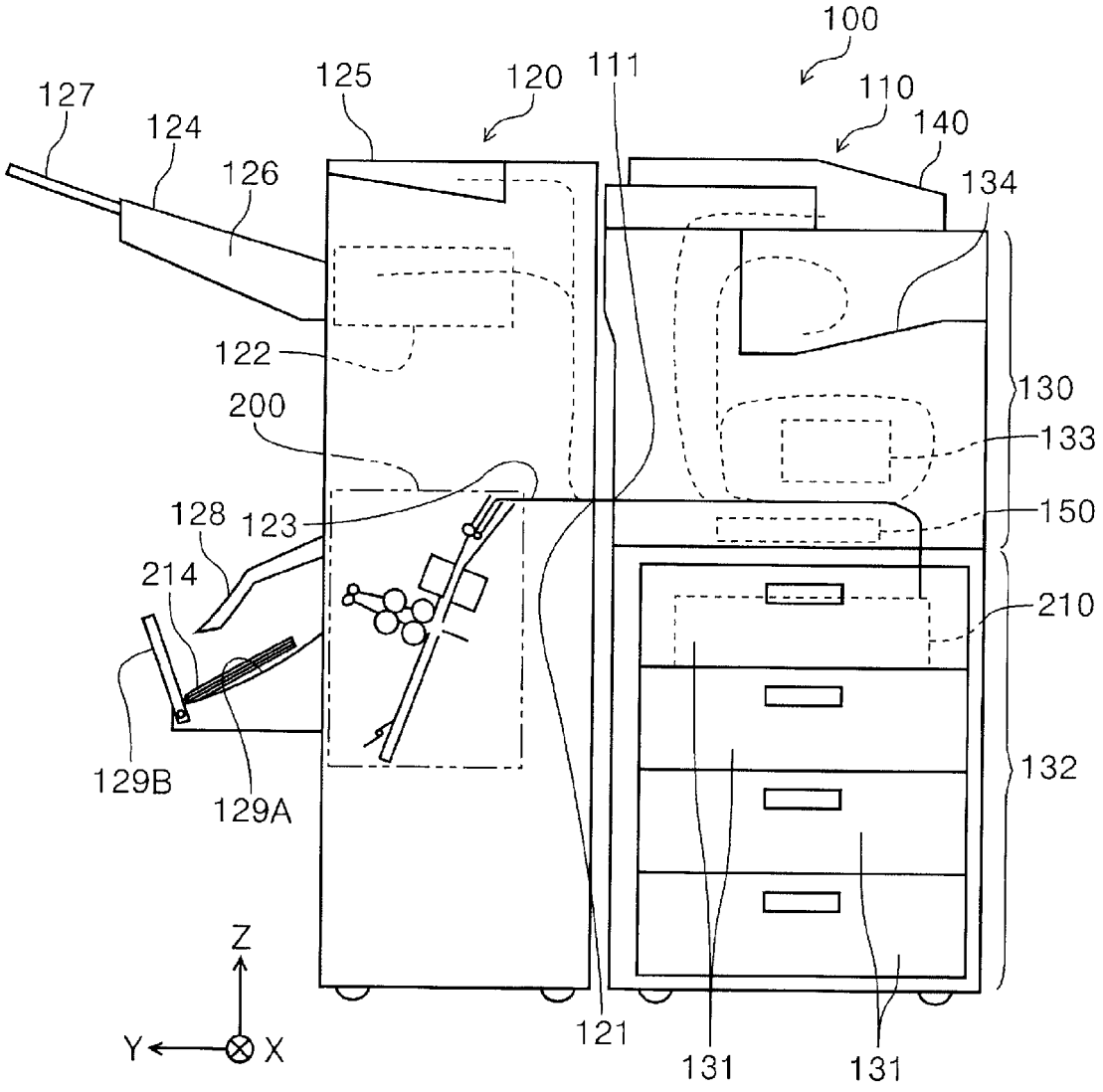
FIG. 1 is a schematic view of a recording system including a medium processing apparatus.

An outline of the present disclosure will be described first.

A stapling apparatus according to a first aspect of the present disclosure includes a holding portion that receives, stacks, and holds a plurality of mediums transported thereto, a first matching portion positioned downstream of the holding portion in a transport direction, a paddle that applies sending force to the mediums so that leading edge sides of the mediums reach the first matching portion, a stapler that binds the mediums, the leading edge sides of the mediums having been matched by the first matching portion, a folding mechanism portion that folds the mediums that have been bound by the stapler. In the stapling apparatus, the first matching portion is configured to move and is configured to transport the mediums to a performing position of the stapler and a performing position of the folding mechanism portion by moving, and a position where the paddle applies sending force to the mediums differs according to the lengths of the mediums in the transport direction.

According to the present aspect, the stapling apparatus is configured so that the position where the paddle applies sending force to the mediums differs according to the lengths of the mediums. With the above, when the lengths of the mediums are different, the position where the paddle applies sending force to the mediums can be appropriate positions corresponding to the lengths of the mediums.

For example, when the length of the medium in the transport direction is long, the position where the paddle applies sending force to the medium is a position on the lower side of the holding portion. On the other hand, when the length of the medium in the transport direction is short, the position where the paddle applies sending force to the medium can be a position on the upper side of the holding portion.

Accordingly, sending force can be applied to the medium by having the position where the paddle applies sending force to the medium be at a position where the force of feed rollers located upstream in the transport direction reaches the medium. With the above, even when the lengths of the mediums are different, the leading edge side of the medium can reach the first matching portion without the medium being stuck in the transport path. In other words, the leading edge side of the medium can be matched with the leading edge sides of the other mediums.

Furthermore, the first matching portion is configured to move, and by moving, the mediums can be transported to the performing position of the stapler and the performing position of the folding mechanism portion. With the above, the stack of mediums that are stacked on and held by the holding portion can be transported to the stapler and the folding mechanism portion and processes can be performed on the medium.

In a second aspect of the present disclosure according to the first aspect, the paddle may be configured to move and may be configured so that, by moving, a position where the paddle applies sending force to the mediums differs according to the lengths of the mediums in the transport direction.

According to the present aspect, since the paddle can move, by moving the position where the paddle applies sending force to the medium, the paddle can be at different positions according to the length of the medium. With the above, when the lengths of the mediums are different, the position where the paddle applies sending force to the mediums can be appropriate positions corresponding to the lengths of the mediums. Accordingly, even when the lengths of the mediums are different, the mediums can reach the first matching portion. In other words, the medium can be matched with the other mediums.

In a third aspect of the present disclosure according to the second aspect, positions of the first matching portion may change according to the lengths of the mediums in the transport direction.

According to the present aspect, the first matching portion can move to different positions according to the lengths of the mediums. With the above, for example, when the length of the medium is short, the first matching portion is, similar to the paddle, moved to an upper portion of the holding portion so that the distance between the feeding portion and the first matching portion can be reduced, which is an appropriate position according to the length (short length) of the medium.

On the other hand, when the length of the medium is long, the first matching portion is, similar to the paddle, moved to a lower portion of the holding portion so that the distance between the feeding portion and the first matching portion can be increased, which is an appropriate position according to the length (long length) of the medium.

With the above, cases such as the medium being stuck in the middle of the transport path can be reduced and bulging and deforming, rebounding, and the like that are known can be suppressed from occurring.

In a fourth aspect of the present disclosure according to the first to third aspect, a range in which the paddle is configured to move may be from the performing position of the folding mechanism portion to the first matching portion.

According to the present aspect, the range in which the paddle is configured to move the position where the sending force is applied to the medium is between the performing position of the folding mechanism portion and the first matching portion.

The range in which the paddle is configured to move the position where the sending force is applied to the medium when the first matching portion has moved may be between the performing position of the folding mechanism portion and the first matching portion that has moved. With the above, the position where the paddle applies sending force to the medium can be any position between the performing position of the folding mechanism portion and the first matching portion that has moved. With the above, the medium can reach the first matching portion while incidents such as the medium being stuck midway in the transport path is reduced.

In a fifth aspect of the present disclosure according to the fourth aspect, a distance between the position where the paddle applies sending force to the mediums and the performing position of the folding mechanism portion may be equivalent to or larger than half a length between the performing position of the folding mechanism portion and the first matching portion.

According to the present aspect, the position where the paddle applies sending force to the medium is a midpoint between the performing position of the folding mechanism portion and the first matching portion or a position on the first matching portion side with respect to the midpoint. With the above, the distance between the position where the medium abuts against the first matching portion and the position where the paddle applies sending force to the medium is small; accordingly, incidents such as the medium becoming bulged and flexed at a portion between the position where the medium abuts against the first matching portion and the position where the paddle applies sending force to the medium is reduced. With the above, the medium can reach the first matching portion while incidents such as the medium being stuck midway in the transport path is reduced.

A sixth aspect of the present disclosure according to the first aspect may further includes a second paddle. In the sixth aspect, a position where the second paddle applies sending force to the mediums may be between the position where the paddle applies sending force to the mediums and the performing position of the folding mechanism portion.

The present aspect further includes the second paddle between the paddle and the folding mechanism portion. With the above, even in a case in which a medium having a short length is transported when the paddle is positioned at the position for when the length of the medium is long, the second paddle can apply sending force to the medium and send the medium to the paddle. Accordingly, incidents such as the medium being stuck midway in the transport path can be reduced further and the medium can reach the first matching portion.

In a seventh aspect of the present disclosure according to the sixth aspect, a distance between the position where the second paddle applies sending force to the mediums and the performing position of the folding mechanism portion may be equivalent to or larger than a sum of half a distance between the first matching portion and the position where the paddle applies sending force to the mediums and a distance between the performing position of the folding mechanism portion and the position where the paddle applies sending force to the mediums.

According to the present aspect, the position where the paddle applies sending force to the medium is on the first matching portion side with respect to a midpoint between the second paddle and the first matching portion. With the above, the distance between the position where the medium abuts against the first matching portion and the position where the paddle applies sending force to the medium is small; accordingly, incidents such as the medium being buckled at a portion between the position where the medium abuts against the first matching portion and the position where the paddle applies sending force to the medium is reduced. In other words, the medium can reach the first matching portion while incidents such as the medium being stuck midway in the transport path is reduced.

In an eighth aspect of the present disclosure according to the first aspect, paddles may be provided at a plurality of positions different in a direction extending along a holding surface of the holding portion that holds the mediums, and the position where the paddles apply sending force to the mediums may be configured to be different according to the length of the mediums in the transport direction by changing a position of the first matching portion according to the length of the mediums in the transport direction and by selectively using each paddle at the plurality of positions.

According to the present aspect, the paddles are provided at the plurality of positions different in the direction extending along the holding surface that holds the medium. With the above, when mediums having different lengths are transported, sending force to the mediums can be applied to different positions according to the lengths of the mediums by changing the position of the first matching portion alone to positions according to the lengths of the mediums without changing the positions of the paddles. Accordingly, the leading edge side of the medium can reach the first matching portion.

In a ninth aspect of the present disclosure according to the second or third aspect, the paddle may move in accordance with a movement of each medium.

According to the present aspect, the paddle is capable of applying sending force to the medium and moving the position while moving in accordance with the movement of the medium. With the above, incidents such as the medium being stuck midway in the transport path can be reduced further and the medium can reliably reach the first matching portion.

In a tenth aspect of the present disclosure according to any one of the first to eighth aspects, the paddle may include a plurality of vanes that rotate about a rotation shaft, and a radius of a circle formed by trajectories of leading edges of the vanes, the trajectories being formed by a rotation of the rotation shaft, may be longer than a distance between an upstream end of the first matching portion on a side opposing a side on which the mediums are stacked and the position where the paddle applies sending force to the mediums.

According to the present aspect, the paddle is configured of vanes that rotate about the rotation shaft, and the position where the paddle applies sending force to the medium is at least where the leading edges of the rotating vanes come in contact with the upstream end of the first matching portion on the side opposing the side on which the mediums are stacked. With the above, the paddle is capable of applying sending force to the medium to a position near the first matching portion so that the medium reaches the first matching portion. With the above, incidents such as the medium being stuck midway in the transport path can be reduced further and the medium can reach the first matching portion.

An eleventh aspect of the present disclosure is a method of controlling a stapling apparatus that includes a holding portion that receives, stacks, and holds a plurality of mediums transported thereto, a first matching portion positioned downstream of the holding portion in a transport direction, a paddle that applies sending force to the mediums so that leading edge sides of the mediums reach the first matching portion, a stapler that binds the mediums, the leading edge sides of the mediums having been matched by the first matching portion, a folding mechanism portion that folds the mediums that been bound by the stapler, and a control unit that controls the first matching portion and the paddle, the method of controlling the stapling apparatus including transporting the mediums to a performing position of the stapler and a performing position of the folding mechanism portion by moving the first matching portion, and differentiating positions where the paddle applies sending force to the mediums according to lengths of the mediums in the transport direction.

A twelfth aspect of the present disclosure according to the eleventh aspect, the control unit controls differentiating the positions where the paddle applies sending force to the mediums according to the lengths of the mediums in the transport direction by moving the paddle.

A thirteenth aspect of the present disclosure according to the twelfth aspect, the control unit controls changing the positions of the first matching portion according to the lengths of the mediums in the transport direction.

EXEMPLARY EMBODIMENT

Hereinafter, an exemplary embodiment of the present disclosure will be described with reference to the drawings. The following description illustrates an example of a configuration of the present disclosure and does not narrowly limit the technical scope of the present disclosure. Note that in the drawings, elements or members that are the same or similar to each other are attached with the same reference numeral and redundant description thereof will be omitted.

In the X-Y-Z coordinate system in each of the drawings, the X-axis direction indicates a depth direction of the apparatus, the Y-axis direction indicates a width direction of the apparatus, and the Z-axis direction indicates a height direction of the apparatus. In other words, the X-axis direction in each drawing is a horizontal direction, the Y-axis direction is a horizontal direction that is orthogonal to the X-axis direction, and the Z-axis direction is a vertical direction.

Outline of Recording System

A recording system 100 illustrated in FIG. 1 includes a recording unit 110, and a processing unit 120 that includes a stapling apparatus 200.

The recording system 100 is configured so that settings of the recording unit 110 and the processing unit 120 can be input from an operation panel (not shown). The operation panel can be provided in the recording unit 110, for example.

The recording unit 110 performs recording on a transported medium 210. The processing unit 120 performs a predetermined process on the medium 210 on which recording has been performed in the recording unit 110. Hereinafter, details of the recording unit 110, the processing unit 120, and the stapling apparatus 200 will be described in the above order.

In the present exemplary embodiment, the medium 210 includes, for example, cut paper. The medium 210 has a rectangular sheet-shaped form, the sides of which have predetermined lengths. The medium 210 is formed of a flexible material, and recording can be performed on the surfaces of the medium 210 with the recording unit 110. The material of the medium 210 is, for example, paper; however, the material is not limited to paper.

The recording unit 110 performs recording on the transported medium 210. The processing unit 120 performs a predetermined process on the medium 210 on which recording has been performed in the recording unit 110. Descriptions of the recording unit 110 and the processing unit 120 will be given below.

Recording Unit

The recording unit 110 is configured as a multifunction machine that includes a printer unit 130 that performs recording on the medium 210, and a scanner unit 140. In the present exemplary embodiment, the recording mode of the printer unit 130 is a so-called ink jet recording that performs recording by discharging ink, which is a liquid, on the medium 210.

A cassette accommodation portion 132 that includes a plurality of medium storage cassettes 131 is provided below the printer unit 130. The medium 210 stored in the medium storage cassette 131 is sent to a recording area 133 and a recording operation is performed. The medium 210 on which recording has been performed is sent to a post-recording discharge tray 134.

A control unit 150 that controls operations related to the transport and the recording of the medium 210 in the recording unit 110 is provided in the recording unit 110. Note that in the recording system 100, the recording unit 110 and the processing unit 120 are coupled to each other and are configured to transport the medium 210 from the recording unit 110 to the processing unit 120.

The control unit 150 is capable of controlling various operations in the processing unit 120 coupled to the recording unit 110.

Processing Unit

Referring next to FIG. 1, an outline of the processing unit 120 will be described.

The processing unit 120 includes a first receiving portion 121 that receives the medium, a first processing portion 122 that performs a first process on the medium that has been received therein through the first receiving portion 121, a sending portion 123 that sends the medium 210 that has been received through the first receiving portion 121 to the stapling apparatus 200 without passing the medium 210 through the first processing portion 122, and the stapling apparatus 200. The above components are housed in a processing unit housing 125.

A first tray 124 that receives the medium 210 to which the first process has been performed and that is discharged from the processing unit 120 is provided on an external side of the processing unit housing 125. The first tray 124 is provided so as to protrude from the processing unit housing 125 that constitutes the appearance of the processing unit 120. In the present exemplary embodiment, the first tray 124 includes a base portion 126 and an extension portion 127. The extension portion 127 is configured to be accommodated in the base portion 126.

A second tray 129A includes, at a distal end thereof in a medium discharge direction, a restriction portion 129B. The restriction portion 129B prevents the stack of mediums discharged to the second tray 129A from protruding from the second tray 129A in the medium discharge direction or prevents the stack of mediums from dropping off from the second tray 129A. Reference numeral 128 is a guide portion 128 that guides the medium 210, which is discharged from the processing unit housing 125, to the second tray 129A.

The medium 210 sent out from the sending portion 123 of the processing unit 120 passes through a transport path 201 of the stapling apparatus 200 (FIG. 2A) described later and is sent to a feeding portion 270. A pair of feed rollers 271 are disposed in the feeding portion 270. The medium 210 is sent out towards a T(+) side in a transport direction T with the pair of feed rollers 271.

Stapling Apparatus

First Example: FIGS. 2A to 3B

Referring to FIGS. 2A to 3B, the stapling apparatus 200 according to a first example will be described.

Figure 2A:
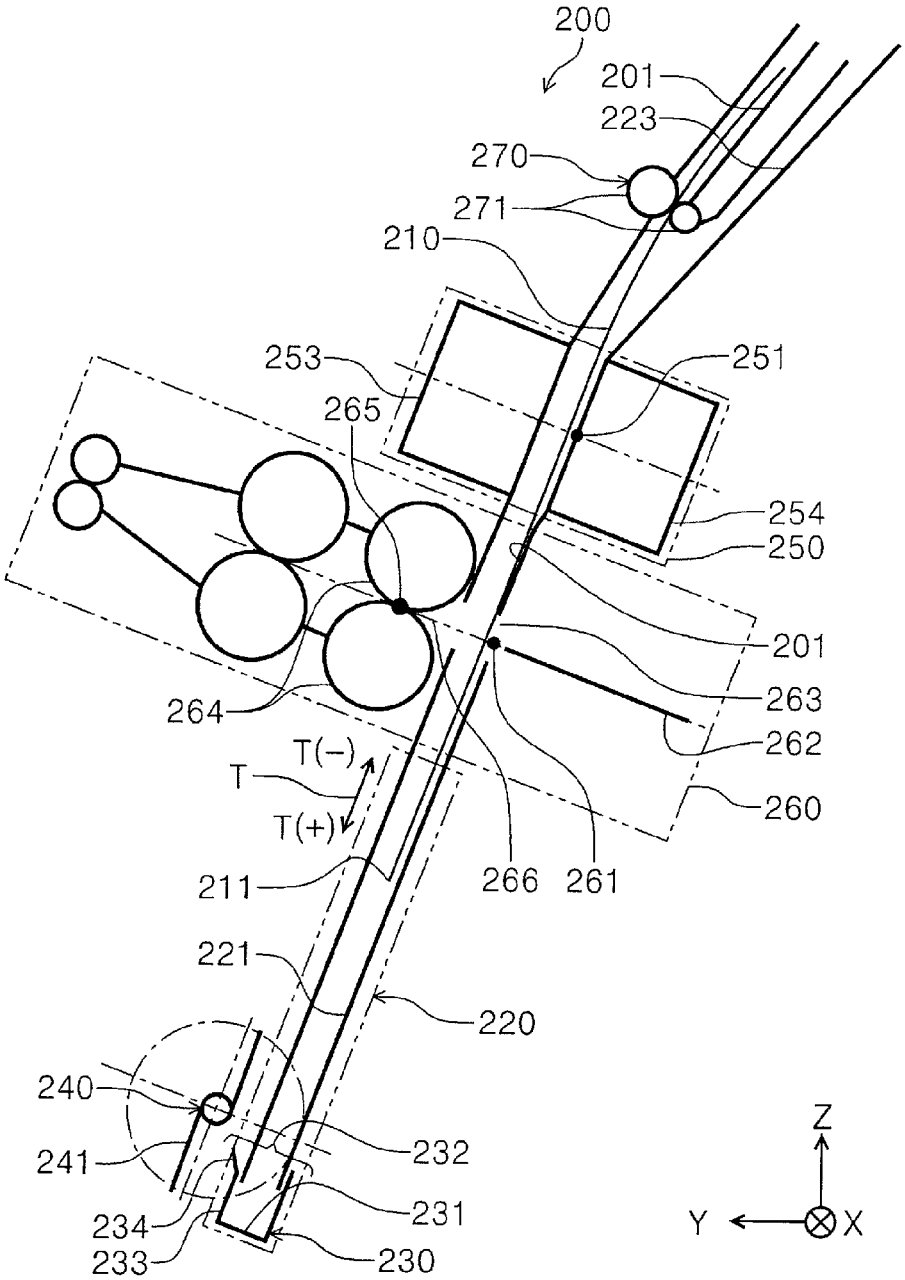
FIG. 2A is a schematic cross-sectional view of the processing apparatus according to a first example and illustrates a state in which a first matching portion is near a lowermost end of the positions where the first matching portion receives a medium.

As illustrated in FIG. 2A, the stapling apparatus 200 includes a holding portion 220 that receives, stacks, and holds the plurality of mediums 210 that have been transported thereto, a first matching portion 230 positioned downstream of the holding portion 220 in the transport direction (hereinafter, also referred to as a "moving direction") T, a paddle 240 that applies sending force to the mediums 210 so that leading edge sides 211 of the mediums 210 reach the first matching portion 230, a stapler 250 that binds the mediums 210, the leading edge sides 211 of which have been matched with the first matching portion 230, and a folding mechanism portion 260 that folds the stack of mediums 210 that have been bound by the stapler 250.

Figure 2B:
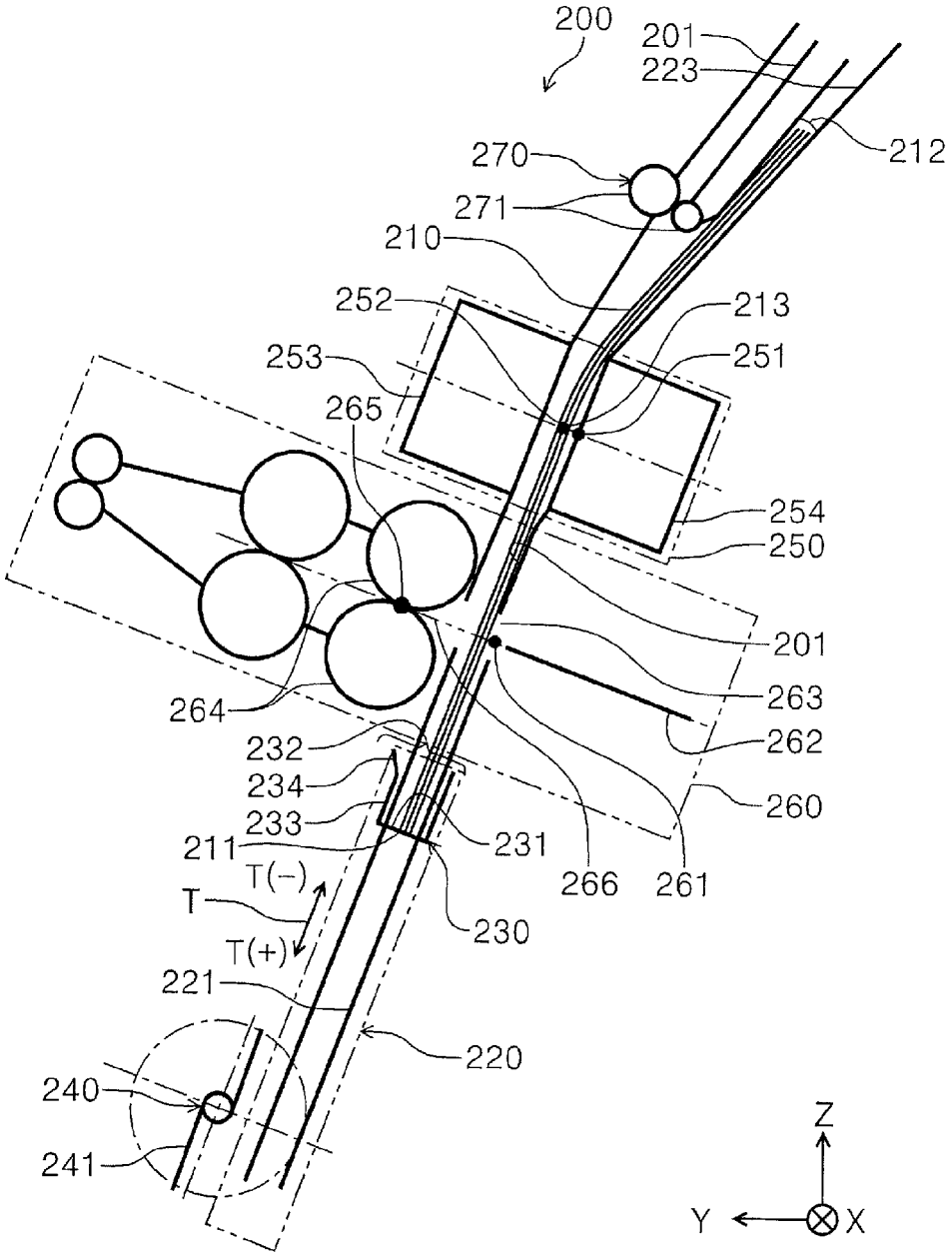
FIG. 2B is a schematic cross-sectional view of the processing apparatus according to the first example and illustrates a state in which the first matching portion is moving a stack of mediums towards a processing portion.

Furthermore, as illustrated in FIG. 2B, the first matching portion 230 is configured to move in the transport direction T. By moving upstream, or in a T(−) direction, the first matching portion 230 is configured to be transported between a stapling performing position 251 that is a position where the process of the stapler 250 on the stack of mediums 210 is performed, and a folding performing position 261 that is a position where the process of the folding mechanism portion 260 is performed. FIG. 2A illustrates a state in which the first matching portion 230 is near a lowermost end of an area in which the first matching portion 230 can move in the transport direction T, which is near a lowermost position where the first matching portion 230 can receive the medium 210. As for the device moving the first matching portion 230, for example, a rack and pinion mechanism that is operated by motive power of a drive source (not shown), a belt moving mechanism, or another linear motion device can be used.

Furthermore, the positions where the paddle 240 applies sending force to the mediums 210 differ according to the lengths of the mediums 210.

In the present example, the paddle 240 is configured to move in the transport direction T so that by moving the paddle 240, the position at which the paddle 240 applies sending force to the medium 210 differs according to the length of the medium 210. FIG. 2A illustrates a state in which the paddle 240 is near a lowermost end in an area in which the paddle 240 can move in the transport direction T.

Figure 3A:
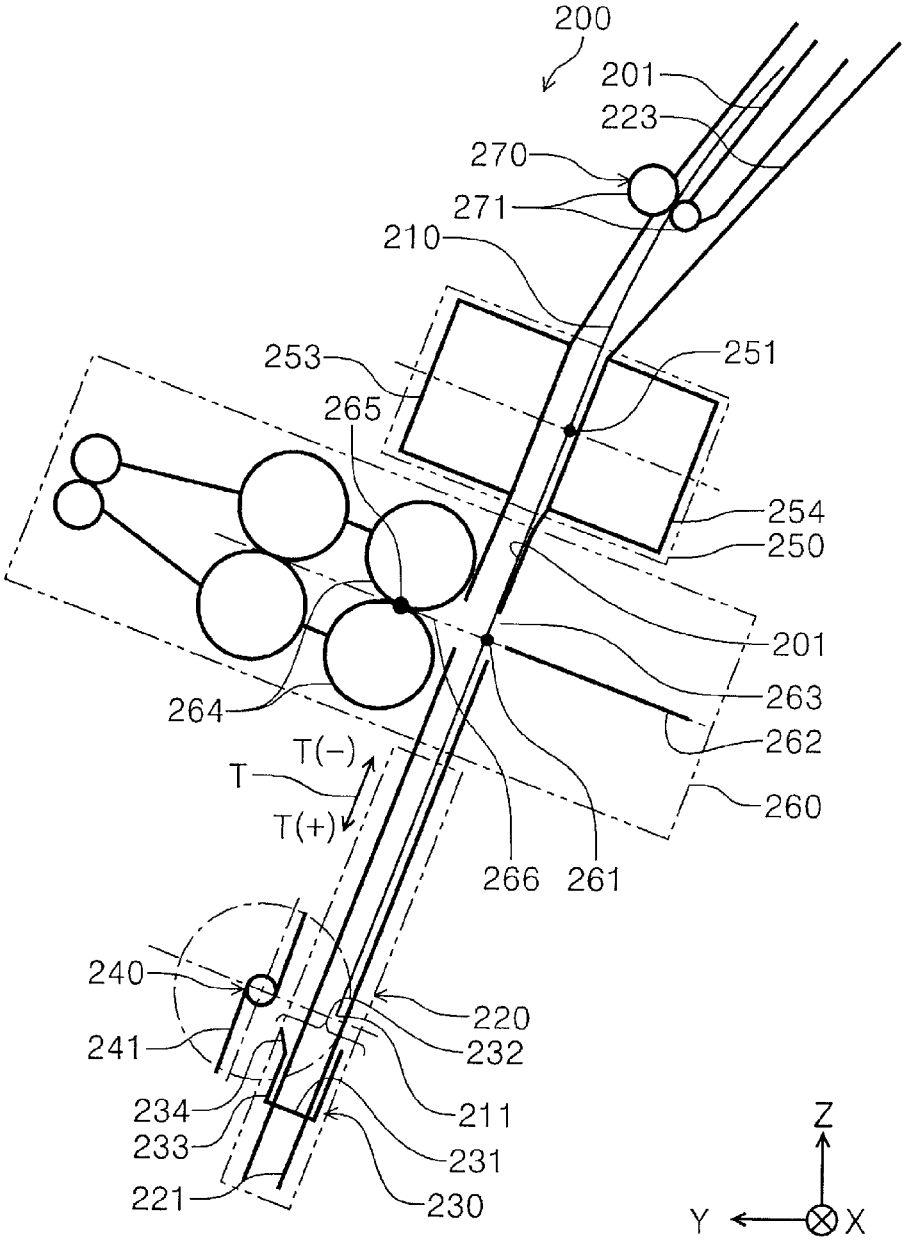
FIG. 3A is a schematic side view of the processing apparatus according to the first example and illustrates a state in which a paddle has moved to a position corresponding to the length of the medium (a long medium).
Figure 3B:
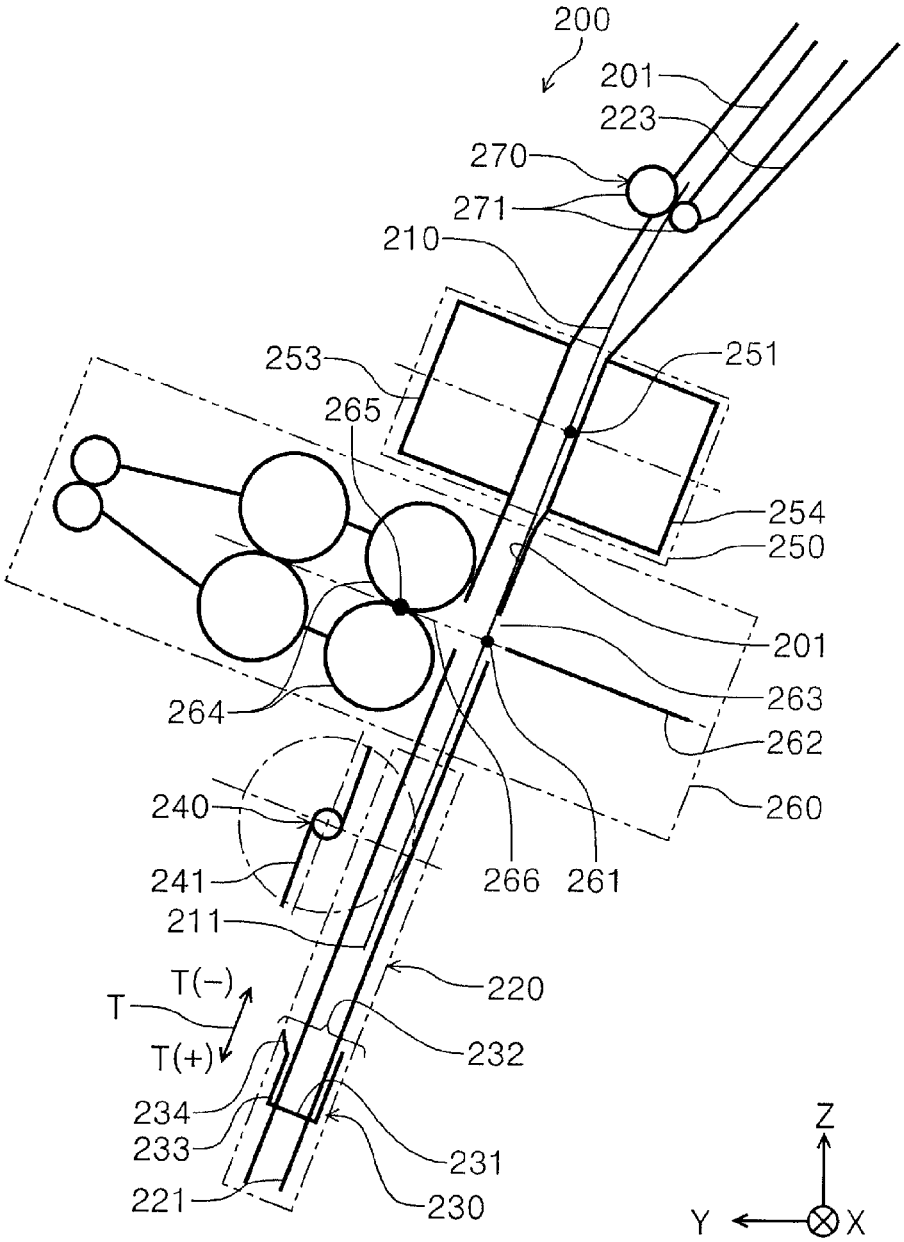
FIG. 3B is a schematic side view of the processing apparatus according to the first example and illustrates a state in which the paddle has moved to another position corresponding to the length of the medium (a short medium).

FIG. 3A illustrates a state in which the paddle 240 has been moved to a position corresponding to a medium 210 with a long length, and FIG. 3B illustrates a state in which the paddle has been moved to another position corresponding to a medium 210 with a short length.

The reason for taking the above positions will be described below. When the length of the medium 210 is long, the leading edge side 211 of the medium 210 can reach a downstream portion of the holding portion 220 in the transport direction T while the medium 210 receives sending force from the pair of feed rollers 271 of the feeding portion 270. On the other hand, when the length of the medium 210 is short, the position where the leading edge side 211 of the medium 210 can reach while receiving the sending force is shorter (upstream) than that of the long medium 210. The position of each paddle 240 in FIGS. 3A and 3B is based on the length of the medium 210.

In the present example, the first matching portion 230 includes an abutting portion 231 against which the leading edge side 211 of the medium 210 abuts. The first matching portion 230 further includes a holding portion 232 that holds a stack 212 of the medium. The holding portion 232 includes holding plates 233 at both ends of the abutting portion 231 in the thickness direction of the medium 210. Switching between a holding state and a release state of the abutting portion 231 is performed by an instruction from the control unit 150. The holding portion 232 includes, for example, an electromagnetic cylinder. Switching between the holding state and the release state is performed by operating the electromagnetic cylinder.

The holding portion 220 receives the plurality of mediums 210 that have been transported thereto and stacks and holds the mediums 210, the leading edge sides 211 of which have been abutted against and matched by the first matching portion 230, on the holding surface 221. The holding portion 220 includes an inclination in which the portion on the T(+) side in the transport direction T is lower.

As described later, the holding portion 220 is a structure including a slit (see FIGS. 9A and 9B) that allows the first matching portion 230 to move in the transport direction T.

In the present example, the paddle 240 applies sending force to the medium 210 so that the leading edge side 211 of the medium 210 reaches the first matching portion 230. By having the leading edge side 211 of the medium 210 reach and be abutted against the first matching portion 230 with the paddle 240, the leading edge side 211 of the medium 210 is matched with the leading edge sides 211 of the other mediums 210. The position at which the paddle 240 applies sending force to the medium 210 differs according to the length of the medium 210.

The paddle 240 is configured to move towards the T(+) side and the T(−) side in the transport direction T based on the instruction from the control unit 150. The paddle 240 can be constituted by, for example, a rack and pinion mechanism that is operated by motive power of a drive source (not shown), a belt moving mechanism, or another linear motion device.

Flow of Process Performed on Medium by Stapling Apparatus

The medium 210 is sent out from the feeding portion 270 and moves along the transport path 201 in the T(+) direction to where the paddle 240 is located. Sending force is applied to the medium 210 with the paddle 240 so that the medium 210 reaches the first matching portion 230; accordingly, the medium 210 reaches the first matching portion 230. In other words, the leading edge side 211 of the medium 210 abuts against the abutting portion 231 of the first matching portion 230. In the above state, the medium 210 is received by the holding portion 220. The above sending operation is repeatedly performed on a plurality of mediums 210, and the mediums 210 are sequentially stacked and held on the holding surface 221 of the holding portion 220. In other words, matched with the other mediums 210, the medium 210 is held by the holding portion 220.

When a predetermined number of mediums 210 are stacked on the holding portion 220, as illustrated in FIG. 2B, the stack 212 of mediums is transported towards the T(−) side in the transport direction T towards the stapler 250 and the folding mechanism portion 260 with the first matching portion 230.

In the present example, sending force can be applied to the medium 210 by having the position where the paddle 240 applies sending force to the medium 210 be at a position where the force of the pair of feed rollers 271 located upstream in the transport direction T reaches the medium 210. With the above, even when the lengths of the mediums 210 are different, the positions where the paddle 240 applies sending force to the mediums 210 can be appropriate positions corresponding to the length of the mediums 210. Accordingly, even when the lengths of the mediums 210 are different, the leading edge sides 211 of the mediums 210 can reach the first matching portion 230 without the mediums 210 being stuck in the transport path 201.

Figure 4A:
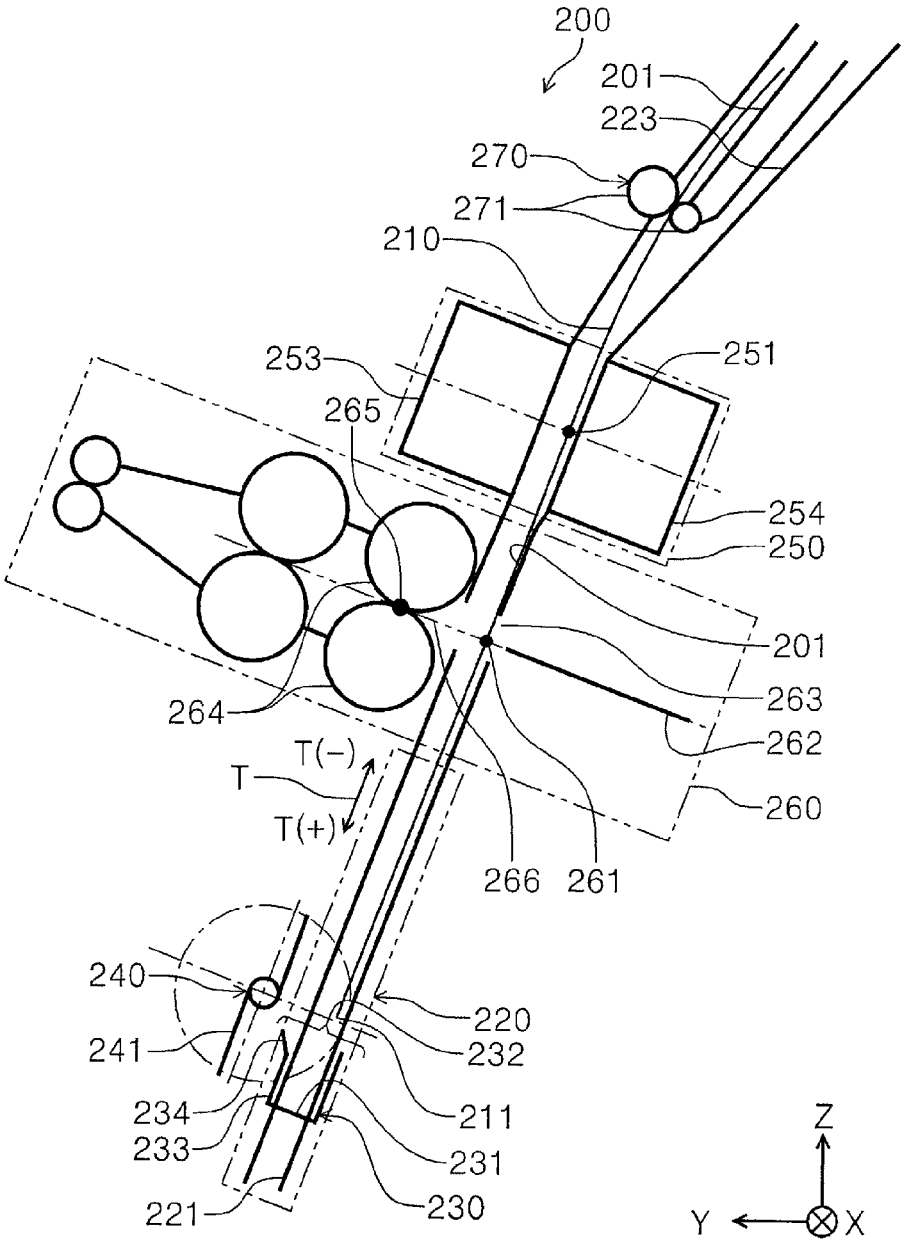
FIG. 4A is a schematic side view according to a second example and illustrates a state in which the first matching portion and the paddle have moved to positions corresponding to a long medium.
Figure 4B:
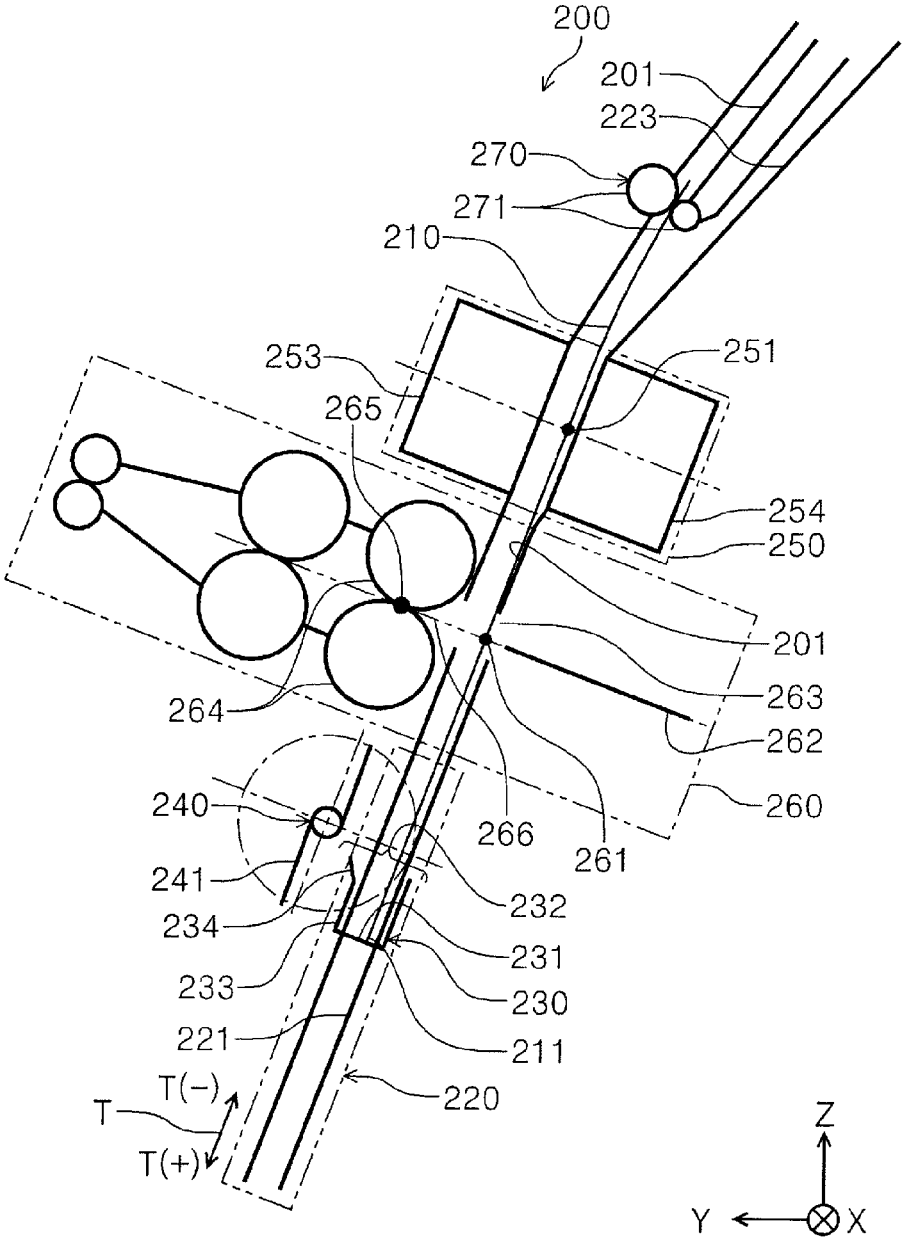
FIG. 4B is a schematic side view according to the second example and illustrates a state in which the first matching portion and the paddle have moved to positions corresponding to a medium shorter than that in FIG. 4A.

Second Example: FIGS. 4A and 4B

In the present example, the first matching portion 230 is further configured to change the position thereof according to the length of the medium 210.

In FIGS. 4A and 4B, the first matching portion 230 is stopped at a position where the first matching portion 230 is slightly moved upstream T(−) from the position illustrated in FIG. 2A. FIG. 4A illustrates a case in which the length of the medium 210 is long. The paddle 240 and the first matching portion 230 are positioned downstream of the holding portion 220. FIG. 4B illustrates a case in which the length of the medium 210 is short. The paddle 240 and the first matching portion 230 are, with respect to the positions illustrated in FIG. 4A, positioned upstream in the holding portion 220. The paddle 240 and the first matching portion 230 may be moved in the transport direction T by a structure that moves the paddle 240 and the first matching portion 230 in an integral manner or by a structure that moves the above separately.

Furthermore, the distances between the pair of feed rollers 271, and the paddle 240 and the first matching portion 230 are set at appropriate distances according to the length of the medium 210. Desirably, the appropriate distances for various types of mediums are prestored in a table or the like, and the control unit 150 automatically selects the appropriate distance from the table according to information on the type of medium 210.

According to the present example, the first matching portion 230 can move to a different position according to the length of the medium 210. With the above, for example, when the length of the medium 210 is short (FIG. 4B), the first matching portion 230 is, similar to the paddle 240, moved to an upper portion of the holding portion 220 so that the distance between the pair of feed rollers 271 and the first matching portion 230 can be reduced, which is an appropriate position according to the length (short length) of the medium 210.

On the other hand, when the length of the medium 210 is long (FIG. 4A), the first matching portion 230 is, similar to the paddle 240, moved to a lower portion of the holding portion 220 so that the distance between the pair of feed rollers 271 and the first matching portion 230 can be increased, which is an appropriate position according to the length (long length) of the medium 210.

With the above, cases such as the medium 210 being stuck in the middle of the transport path 201 can be reduced and bulging and deforming, rebounding, and the like that are known can be suppressed from occurring.

Figure 5:
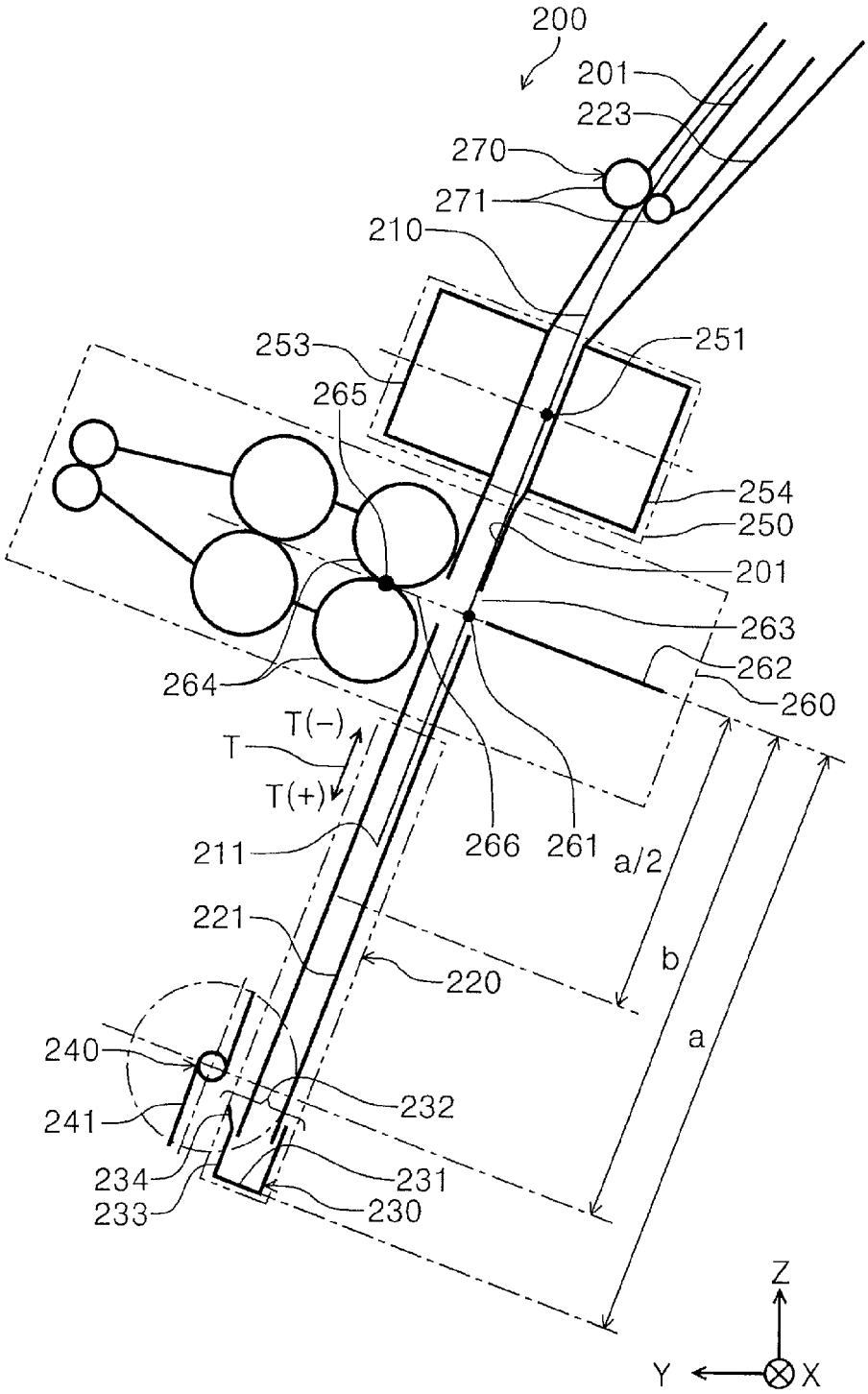
FIG. 5 is a schematic cross-sectional view according to the second example and illustrates positional relationships between the first matching portion, the paddle, and other members.

Referring to FIG. 5, positional relationships between the first matching portion 230, the paddle 240, and other members will be described. In the present example, the range in which the paddle 240 can move is from the folding performing position 261 to the first matching portion 230.

The position where the movable paddle 240 applies sending force to the medium 210 is, desirably, $$a>b \tag{1}$$

where a is a distance from the folding performing position 261 to the abutting portion 231 of the first matching portion 230, and b is a distance from the folding performing position 261 to a rotation center of the paddle 240.

By satisfying the positional relationship expressed by expression (1) described above, the position where the paddle 240 applies sending force to the medium 210 can be any position between the folding performing position 261 and where the first matching portion 230 is positioned after the medium 210 has been moved. With the above, the medium 210 can reach the first matching portion 230 while incidents such as the medium 210 being stuck midway in the transport path 201 is reduced.

Furthermore, as illustrated in FIG. 5, the position where the paddle 240 applies sending force to the medium 210 is, desirably, $$b \geq a/2 \tag{2}$$

Note that the definitions of a and b are the same as those in expression (1).

In other words, the position where the paddle 240 can apply sending force to the medium 210 is a position distanced away from the folding performing position 261 by half a distance between the folding performing position 261 of the folding mechanism portion and the abutting portion 231 of the first matching portion 230, or on the first matching portion 230 side with respect to the above position.

By satisfying the positional relationship expressed by expression (2) described above, the distance between the position where the medium 210 abuts against the first matching portion 230 and the position where the paddle 240 applies sending force to the medium 210 becomes small; accordingly, incidents such as the medium 210 becoming bulged and flexed at a portion between the position where the medium 210 abuts against the first matching portion 230 and the position where the paddle 240 applies sending force to the medium 210 is reduced. With the above, the medium 210 can be made to reach the first matching portion 230 while incidents such as the medium 210 being stuck midway in the transport path 201 is reduced.

Figure 6:
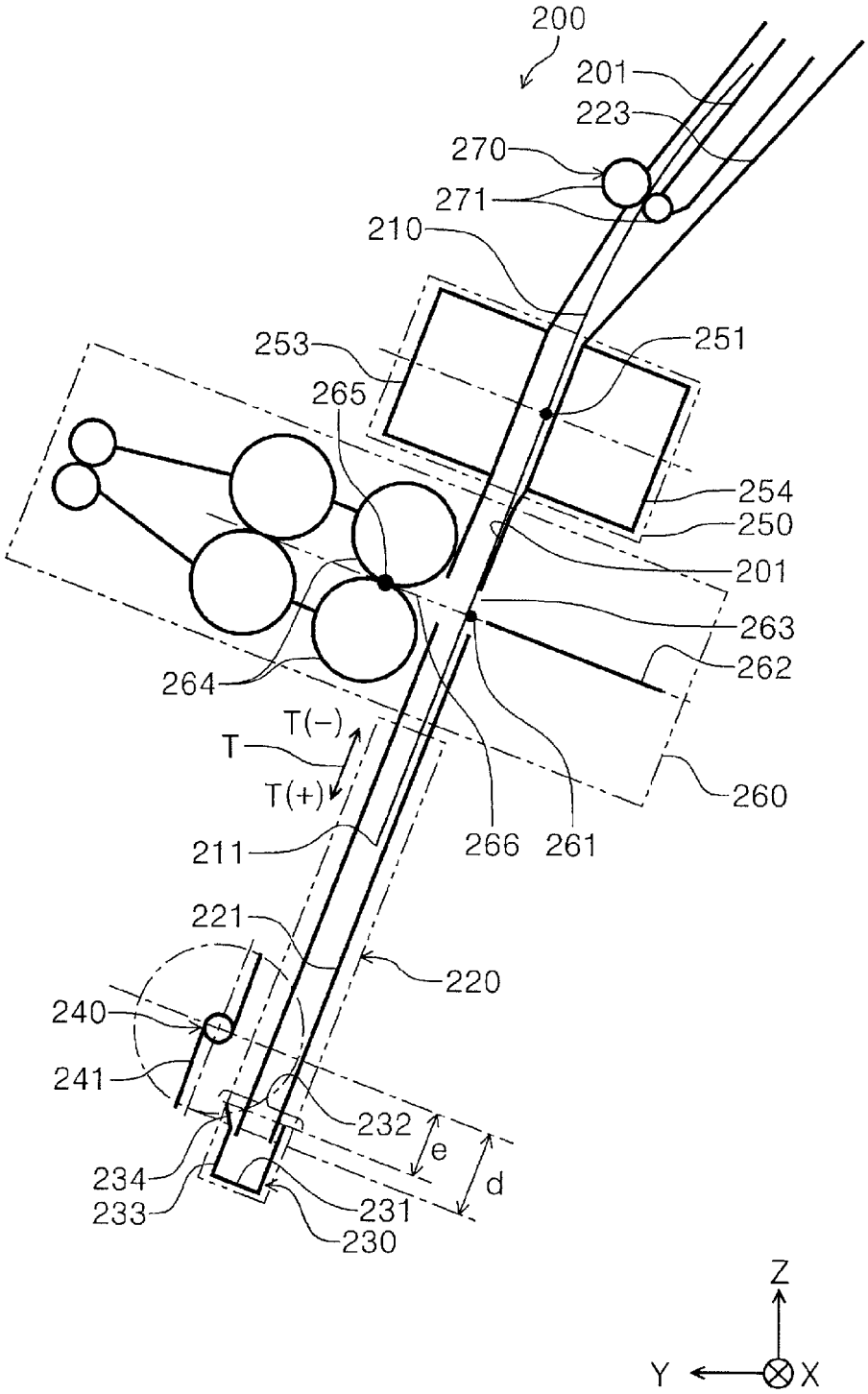
FIG. 6 is a schematic cross-sectional view according to the second example and illustrates a positional relationship between the paddle and the first matching portion.

Referring to FIG. 6, a positional relationship between the paddle 240 and the first matching portion 230 will be described. In the present example, the paddle 240 includes a plurality of rectangular strip shaped vanes 241. The vanes are formed of a flexible material, and by having the leading edges of the vanes 241 come in contact with the surface of the medium 210, sending force is applied to the medium 210.

The position where the paddle 240 applies sending force that sends the medium 210 to the first matching portion 230 is, desirably, $$d>e \tag{3}$$

where d is a distance between the rotation center of the paddle 240 and the leading edge of each vane 241, and e is a distance between an upstream end 234 of the holding plate 233 on the side opposing the holding surface 221 of the first matching portion 230 and the rotation center of the paddle 240.

In other words, the position where the paddle 240 applies sending force that sends the medium 210 to the first matching portion 230 is, desirably, a position where the leading edge of each vane 241 included in the rotating paddle 240 comes in contact with the upstream end 234 of the holding plate 233 on the side opposing the holding surface 221 of the first matching portion 230.

By satisfying the positional relationship expressed by expression (3) described above, the paddle 240 can apply sending force, which sends the medium 210 to the first matching portion 230, right up to a position close to the first matching portion 230. With the above, the medium 210 can be made to reach the first matching portion 230 while incidents such as the medium 210 being stuck midway in the transport path 201 is reduced.

Figure 7A:
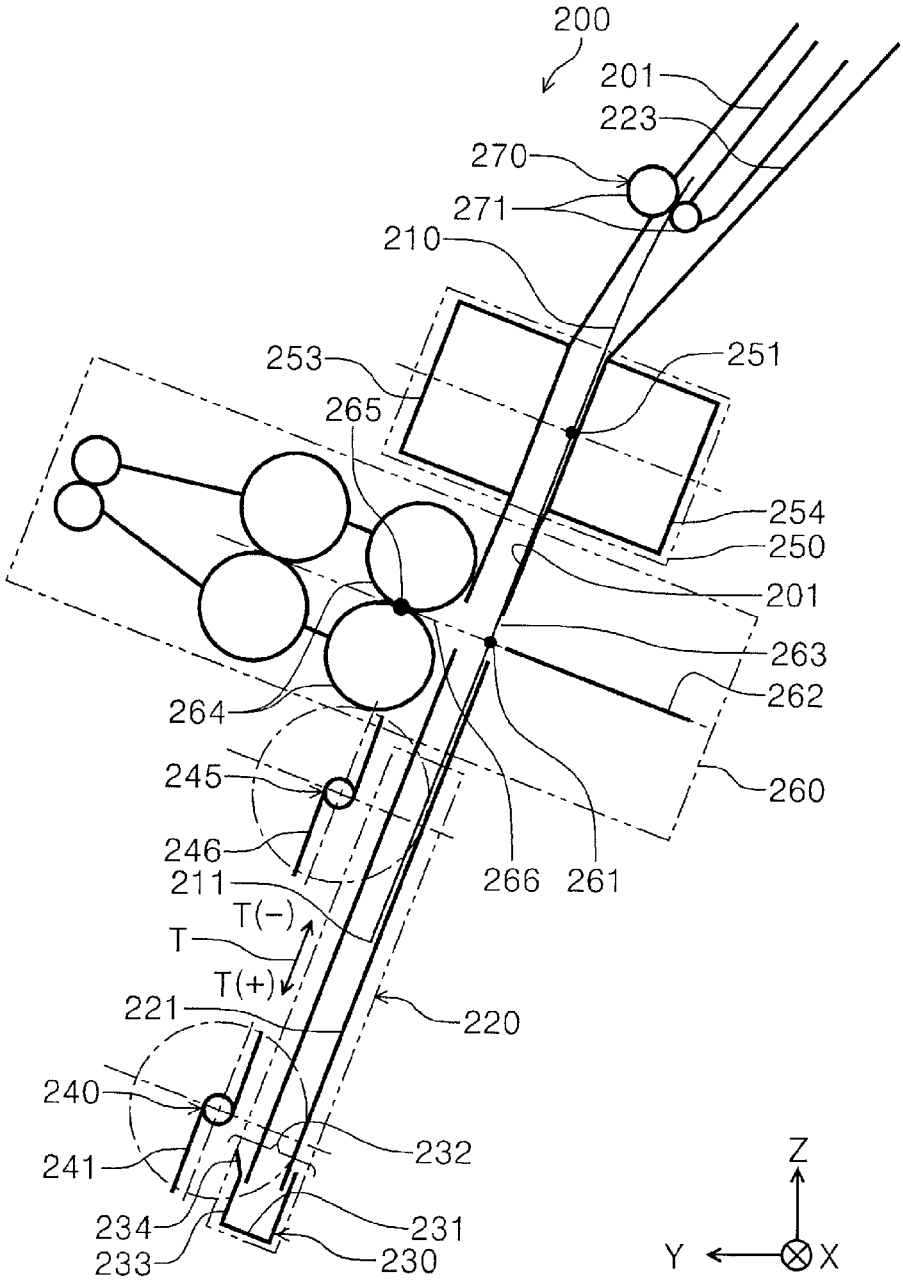
FIG. 7A is a schematic cross-sectional view according to a third example that includes a second paddle and illustrates, after the start of sending the medium with the second paddle, a state before a leading edge of the medium reaches a sending position of the paddle.
Figure 7B:
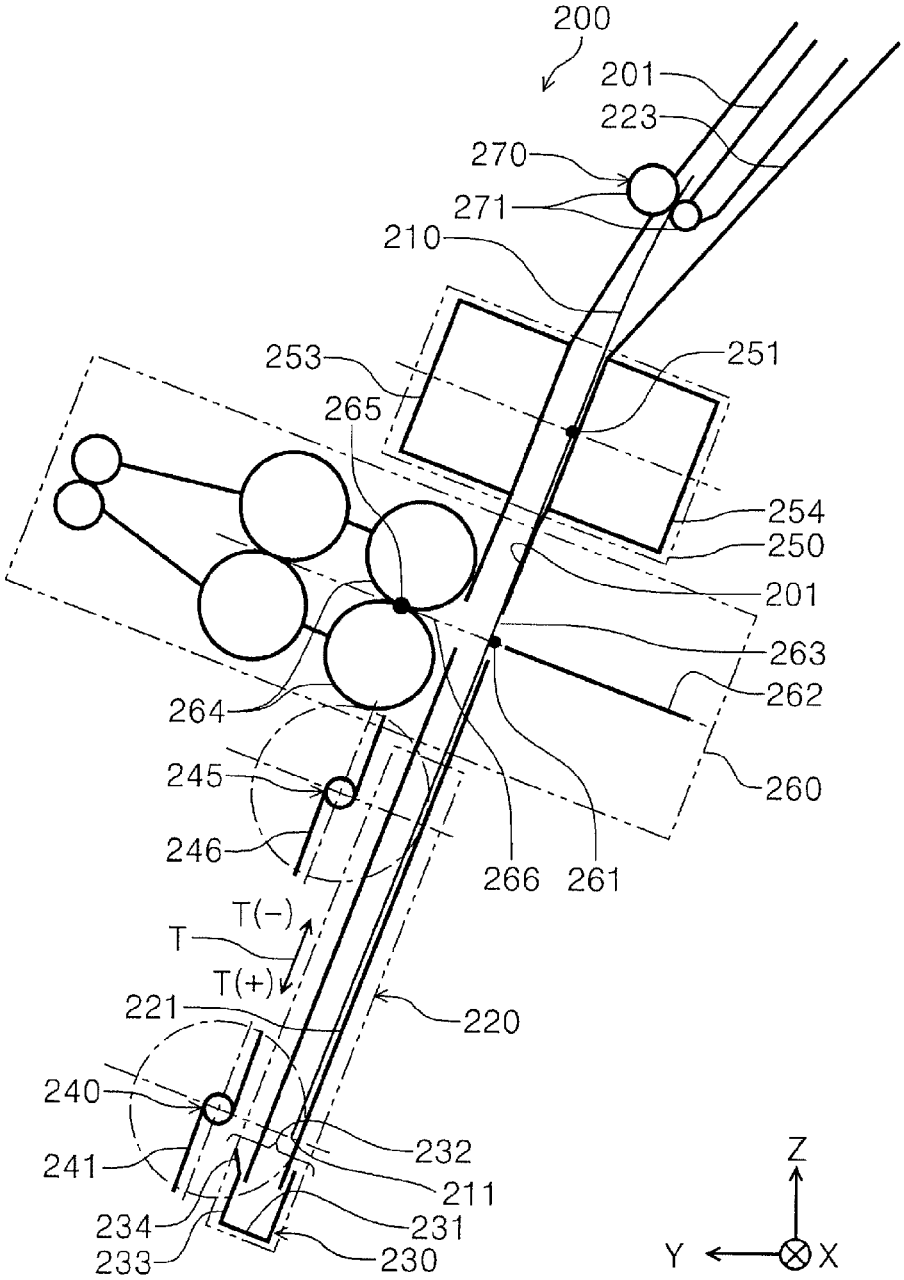
FIG. 7B is a schematic cross-sectional view according to the third example and illustrates, after the start of sending the medium with the second paddle, a state in which the leading edge of the medium has arrived at the sending position of the paddle.
Figure 7C:
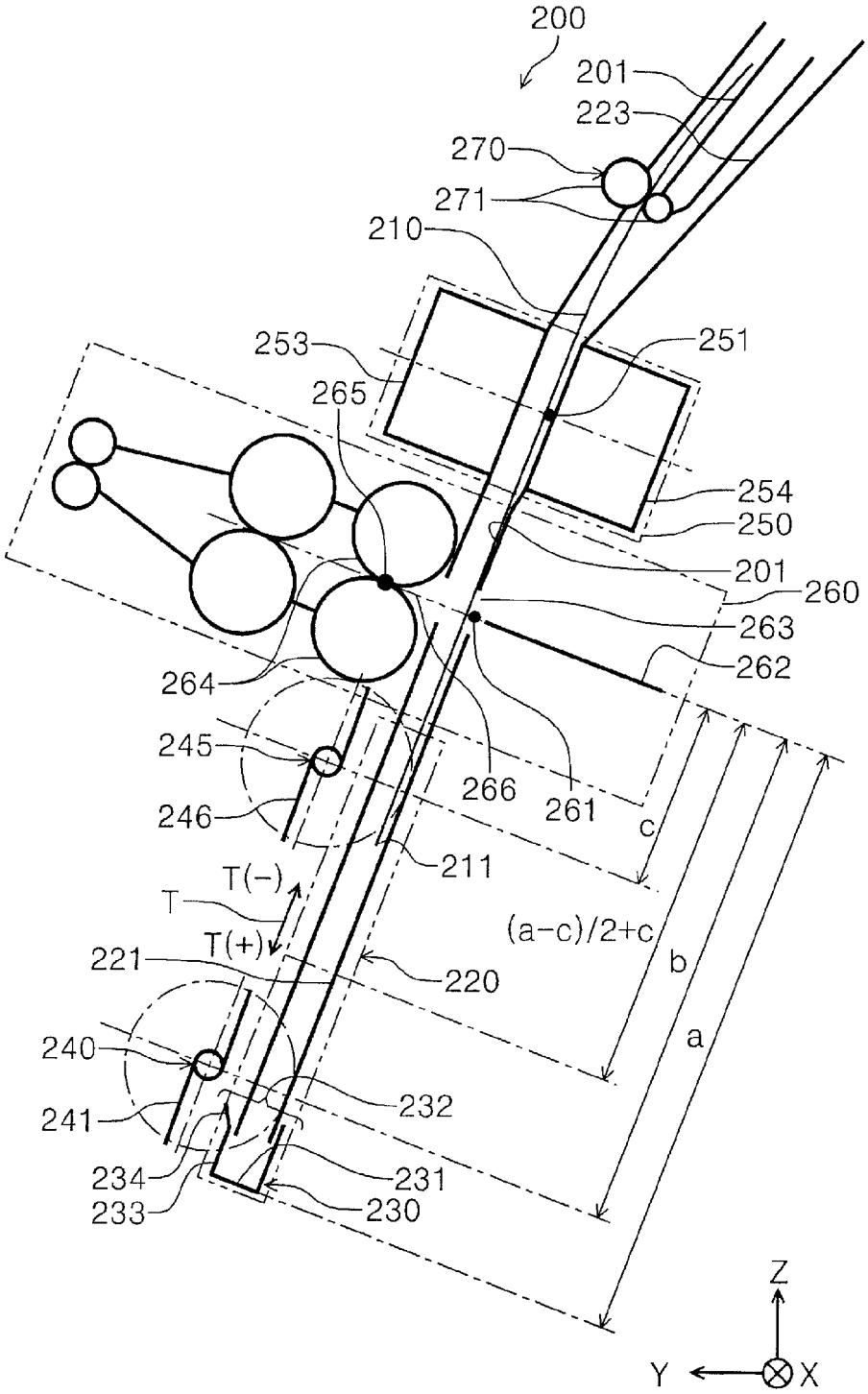
FIG. 7C is a schematic cross-sectional view according to the third example and illustrates positional relationships between the first matching portion, the paddles, and other members.

Third Example: FIGS. 7A to 7C

The present example further includes a second paddle 245. Furthermore, the position where the second paddle 245 applies sending force to the medium 210 is between the position where the paddle 240 applies sending force to the medium 210 and the folding performing position 261.

The second paddle 245 is disposed between the paddle 240 and the folding performing position 261. With the above, even in a case in which a medium 210 having a short length is transported when the paddle 240 is positioned at the position for when the length of the medium 210 is long, the second paddle 245 can apply sending force to the medium 210 and send the medium 210 to the paddle 240.

Desirably, $$b>c \tag{4}$$

is satisfied, where c is a distance between the position where the second paddle 245 applies sending force to the medium 210 and the folding performing position 261. Note that the definition of b is the same as that in expression (1).

In other words, the paddle 240 is positioned on the T(+) side with respect to the position of the second paddle 245, which is downstream in the transport direction T.

The position where the second paddle 245 applies sending force to the medium 210 is, desirably, $$b\geq(a-c)/2+c \tag{5}$$

Note that the definitions of a and b are the same as those in expression (1).

In other words, desirably, the position where the paddle 240 applies sending force to the medium 210 is in the middle of a portion between the abutting portion 231 of the first matching portion 230 and the position where the second paddle 245 applies sending force to the medium 210, or on the first matching portion 230 side with respect to the above position.

By satisfying the positional relationship expressed by expression (5) described above, the distance between the position where the medium 210 abuts against the first matching portion 230 and the position where the paddle 240 applies sending force to the medium 210 becomes small; accordingly, incidents such as the medium 210 becoming buckled at a portion between the position where the medium 210 abuts against the first matching portion 230 and the position where the paddle 240 applies sending force to the medium 210 is reduced.

Figure 8A:
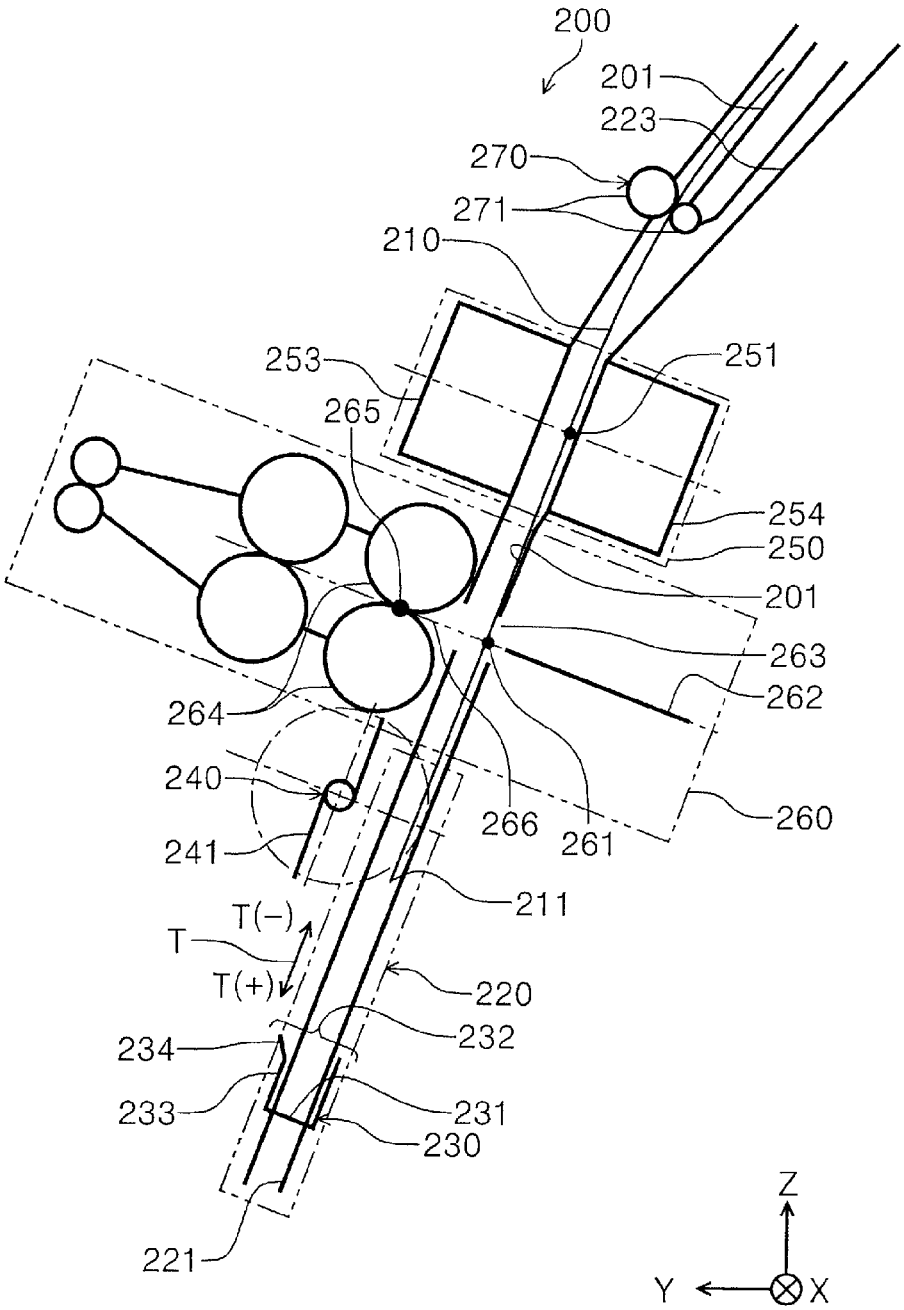
FIG. 8A is a cross-sectional view according to a fourth example and illustrates the paddle positionally moving in accordance with the movement of the medium transported by the paddle.
Figure 8B:
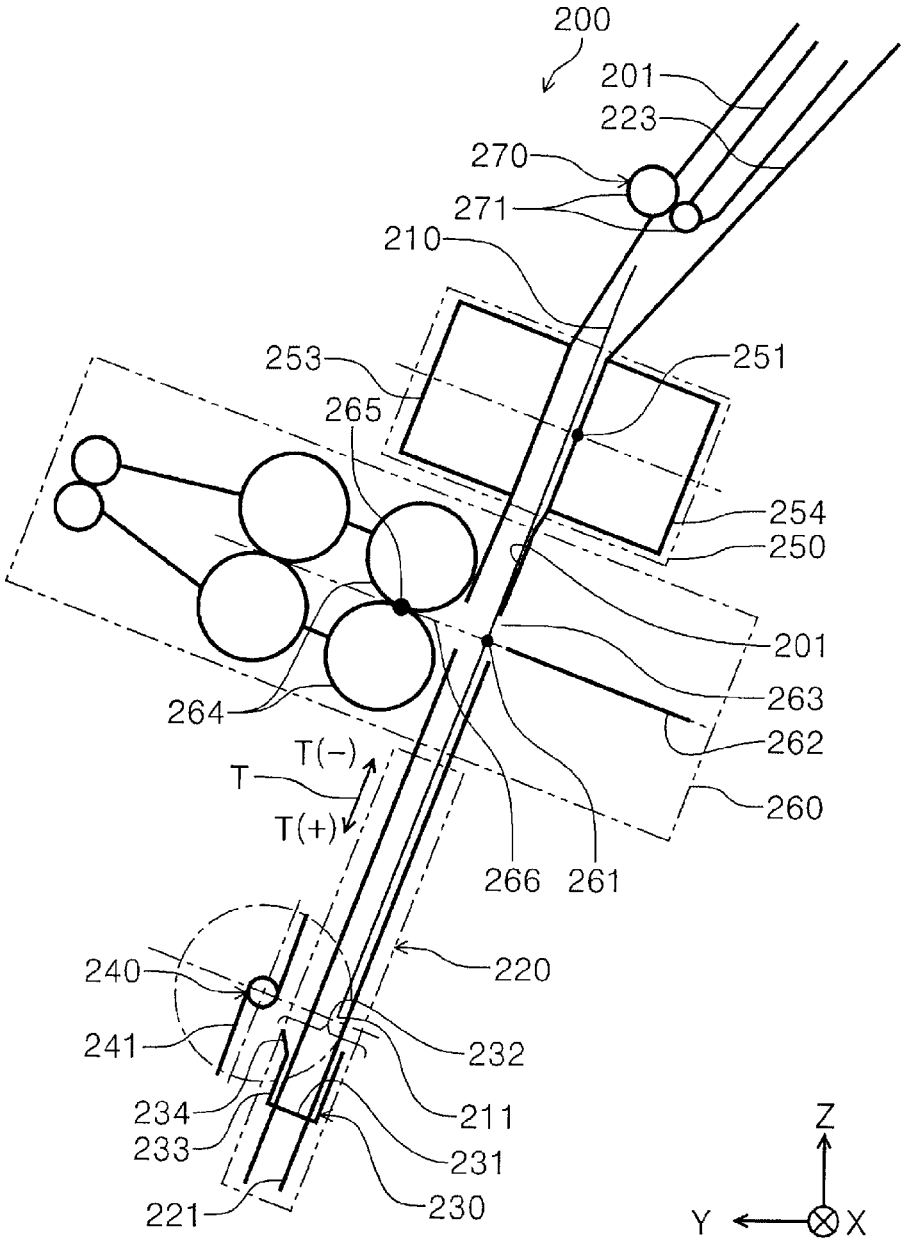
FIG. 8B is a cross-sectional view according to the fourth example and illustrates the paddle positionally moving in accordance with the movement of the medium transported by the paddle.

Fourth Example: FIGS. 8A and 8B

In the present example, the paddle 240 is configured to move in accordance with the movement of the medium 210. FIG. 8A illustrates a state in which the paddle 240 positioned upstream is applying sending force to a portion near the leading edge of the medium 210 that has been sent thereto and illustrates a state in which the medium 210 is moving downstream towards the T(+) side in the transport direction T. FIG. 8B illustrates a state in which the paddle 240 has moved together with the movement of the medium 210 and has moved near the first matching portion 230.

In the present example, the paddle 240 is capable of applying sending force to the medium 210 and moving the position while moving in accordance with the movement of the medium 210. With the above, the medium 210 can be made to reach the first matching portion 230 while incidents such as the medium 210 being stuck midway in the transport path 201 is reduced.

Furthermore, a position detecting member (not shown) that detects the position of the transported medium 210 may be included, and the paddle 240 may be moved based on an instruction that is from the control unit 150 and that has been made based on the output of the position detecting member.

Figure 9A:
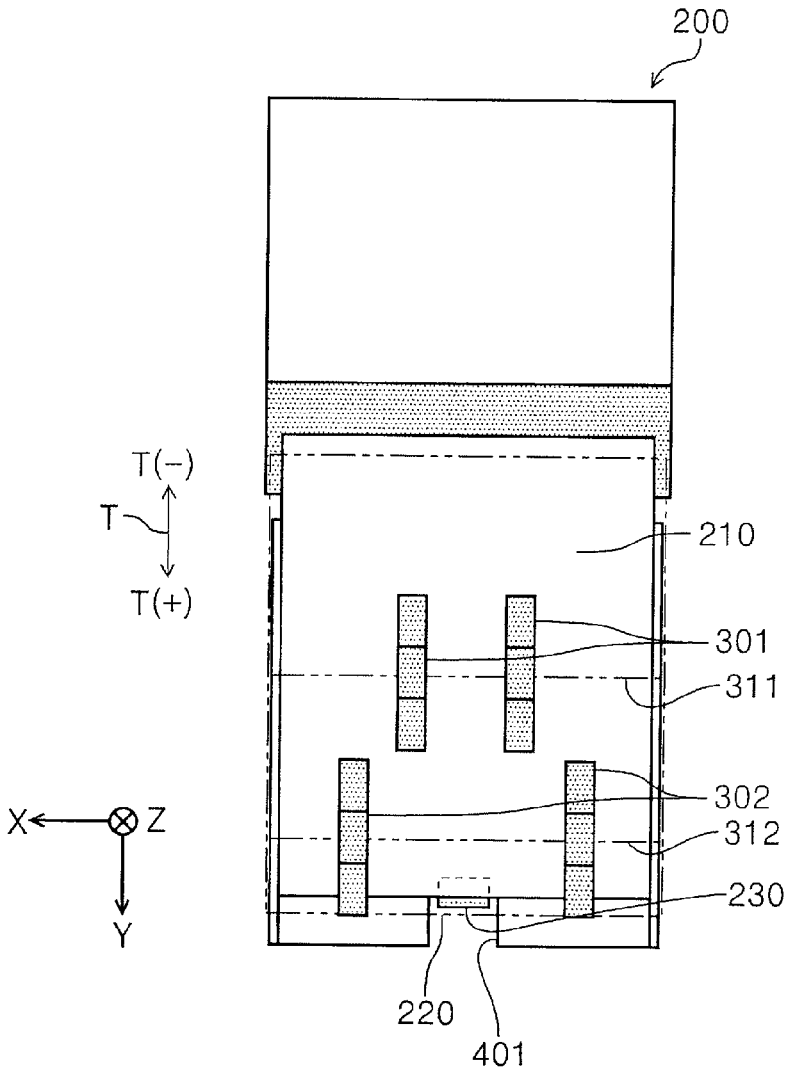
FIG. 9A is a schematic front view according to a fifth example and illustrates a state in which the medium processing apparatus is corresponding to a long medium.
Figure 9B:
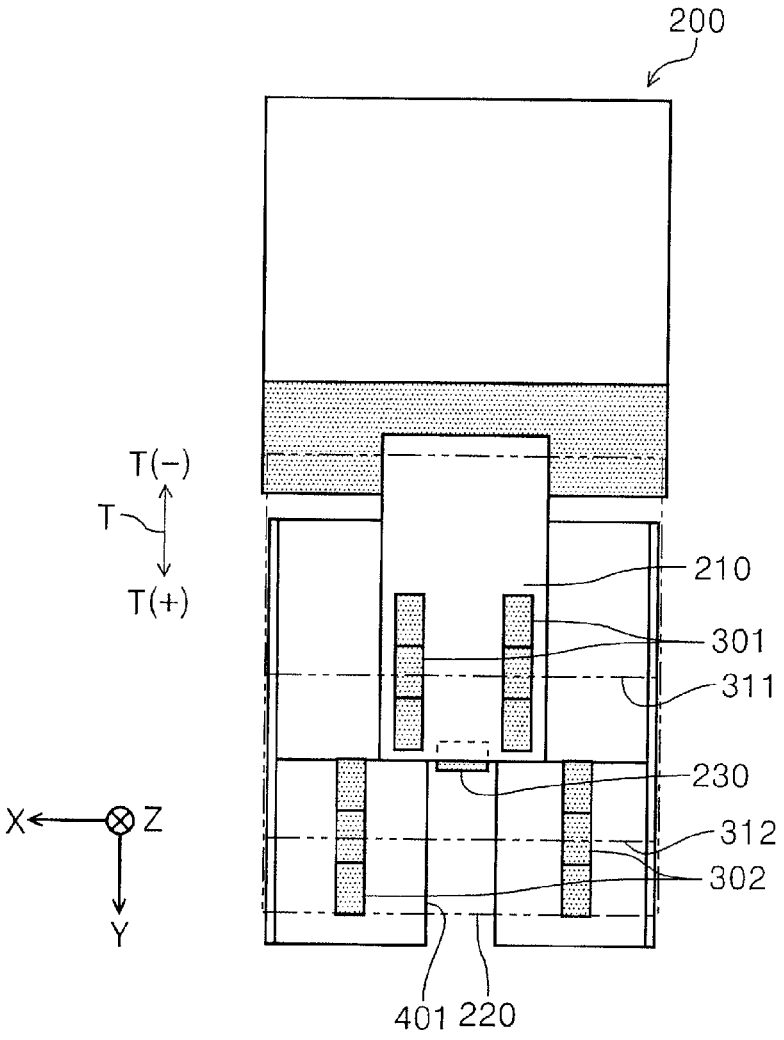
FIG. 9B is a schematic front view according to the fifth example and illustrates a state in which the medium processing apparatus is corresponding to a medium shorter than that in FIG. 9A.

Fifth Example: FIGS. 9A and 9B

A fifth example of the present disclosure will be described with reference to FIGS. 9A and 9B.

In the present example, a plurality of paddles are provided at a plurality of positions different in the transport direction T of the medium 210. In the present example, two paddles, namely, a paddle 301 and a paddle 302 are provided upstream and downstream in the transport direction T in an immobile state. Furthermore, by changing the position of the first matching portion 230 according to the length of the medium 210 and by selectively using the paddles 301 and 302 that are at a plurality of different positions, the position where the paddle 301 or the paddle 302 applies sending force to the medium 210 changes to a different position according to the length of the medium 210.

In the drawings, reference numeral 311 is an axis of the paddle 301, and reference numeral 312 is an axis of the paddle 302. Furthermore, a slit 401 that allows the first matching portion 230 to move in the transport direction T is provided in the holding portion 220.

Note that since the paddles 301 and 302, which are provided at the plurality of different positions in the direction extending along the holding surface 221 of the medium 210, can be selectively used according to the length of the medium 210, the paddle 301 or the paddle 302 alone corresponding to the plurality of mediums 210 with different lengths is used.

FIG. 9A illustrates a state corresponding to a long medium 210, and FIG. 9B illustrates a state corresponding to a medium 210 that is shorter than that in FIG. 9A.

Note that the paddles 301 and 302 provided at a plurality of positions corresponding to the lengths of the mediums 210 may be provided in a plural number in a linear manner at the same position in the direction orthogonal to the transport direction T of the medium 210 or may be provided in a plural number in a staggered manner at different positions in the direction orthogonal to the transport direction T of the medium 210. Desirably, the paddle 301 used for mediums 210 with a short length is disposed on the inner side in the width direction of the medium 210, and the paddle 302 used for mediums 210 with a long length is disposed on the outer side in the width direction of the medium 210.

In the present example, paddles 301 and 302 are provided at a plurality of positions different in the direction extending along the holding surface 221 of the medium 210. With the above, when mediums 210 having different lengths are transported, sending force to the mediums 210 can be applied to different positions according to the lengths of the mediums 210 by changing the position of the first matching portion 230 alone to positions according to the lengths of the mediums 210 without changing the positions of the paddles 301 and 302. Accordingly, the leading edge sides 211 of the mediums 210 can reach the first matching portion 230.

Other Structures

Stapler

Referring to FIG. 2B, a description of the stapler 250 will be given. The stapler 250 performs a binding process on the stack 212 of mediums.

The stapler 250 includes a magazine 253 from which a staple is punched out, and a clincher 254 that bends the staple. The magazine 253 and the clincher 254 are disposed separate from each other so as to interpose the surfaces of the stack 212 of mediums from above and below. A plurality of staplers 250 may be provided at intervals in the width direction that is orthogonal to the moving direction T of the stack 212 of mediums.

The stapler 250 is configured to bind the stack 212 of mediums at a middle portion, or at a binding position 213, of the stack 212 of mediums in the moving direction T. In the binding process with the stapler 250, when the binding position 213 of the stack 212 of mediums is transported to the stapling performing position 251 with the first matching portion 230, the magazine 253 and the clincher 254 hold the stack 212 of mediums in between. Subsequently, when a staple 252 is punched out from the magazine 253, the staple 252 that has been punched out penetrates the stack 212 of mediums and is bent by the clincher 254. The binding process is performed in the above manner. Note that when the stack 212 of mediums is at the stapling performing position, the upstream end of the stack 212 of mediums enters a retracting path 223 that is different from the feeding portion 270.

Folding Mechanism Portion

Referring to FIG. 2B, a description of the folding mechanism portion 260 will be given. The folding mechanism portion 260 performs a folding process on the stack 212 of mediums.

The folding mechanism portion 260 is disposed adjacent to and on the T(−) side of the stapler 250 in the moving direction. The folding mechanism portion 260 includes a blade 262, a folding hole 263 that is provided in the folding performing position 261 and through which the blade 262 passes, a pair of bending rollers 264, a nip position 265 of the pair of bending rollers 264, and an entering path 266 to enter into the nip position 265.

In the folding mechanism portion 260, the blade 262 is disposed on the side of the stack 212 of mediums on the holding surface 221 side, and the pair of bending rollers 264 are disposed on the side of the stack 212 of mediums opposite the above side so that the blade 262 and the pair of bending rollers 264 interpose the surfaces of the stack 212 of mediums from above and below. Furthermore, the folding hole 263 through which the blade 262 passes is provided in the folding performing position 261 in the transport path 201.

The folding mechanism portion 260 is configured to fold the stack 212 of mediums at the middle portion, or at a binding position 213, of the stack 212 of mediums in the moving direction T.

In the folding process of the folding mechanism portion 260, when the binding position 213 of the stack 212 of mediums is transported to the folding performing position 261 with the first matching portion 230, the blade 262 protrudes towards the stack 212 of mediums through the folding hole 263. The stack 212 of mediums is folded at the binding position 213 and is inserted into the nip position 265 of the pair of bending rollers 264 with the protruding blade 262. When the binding position 213 of the stack 212 of mediums is nipped between the pair of bending rollers 264, the stack 212 of mediums is further folded by the rotation of the pair of bending rollers 264. The folding process is performed on the stack 212 of mediums with the folding mechanism portion 260 in the above manner. The stack 212 of mediums on which the folding process has been performed turns into a booklet 214 and is discharged to the second tray 129A.

Note that when the stack 212 of mediums is in the folding performing position 261, the upstream end of the stack 212 of mediums may enter the retracting path 223 that is different from the feeding portion 270.

Other Examples

The stapling apparatus 200 according to the present disclosure is basically configured in the above described manner; however, it goes without saying that some of the components may be changed or discarded within the scope of the gist of the present disclosure.

A second matching portion (not shown) different from the first matching portion 230 may be provided. The second matching portion is configured to move and to maintain the matched state by holding the trailing edges of the mediums 210 held by the holding portion 220.

What is claimed is:

1. A stapling apparatus comprising:

a holding portion that receives, stacks, and holds a plurality of mediums transported thereto;

a first matching portion positioned downstream of the holding portion in a transport direction;

a paddle that applies sending force to the mediums so that leading edge sides of the mediums reach the first matching portion;

a stapler that binds the mediums, the leading edge sides of the mediums having been matched by the first matching portion;

a folding mechanism portion that folds the mediums that have been bound by the stapler, wherein the first matching portion is configured to move, and is configured to transport the mediums to a performing position of the stapler and a performing position of the folding mechanism portion by moving, and a position where the paddle applies sending force to the mediums differs according to the lengths of the mediums in the transport direction.

2. The stapling apparatus according to claim 1, wherein the paddle is configured to move, and is configured so that, by moving, a position where the paddle applies sending force to the mediums differs according to the lengths of the mediums in the transport direction.

3. The stapling apparatus according to claim 2, wherein positions of the first matching portion change according to the lengths of the mediums in the transport direction.

4. The stapling apparatus according to claim 1, wherein
a range in which the paddle is configured to move is from the performing position of the folding mechanism portion to the first matching portion.

5. The stapling apparatus according to claim 4, wherein
a distance between the position where the paddle applies sending force to the mediums and the performing position of the folding mechanism portion is equivalent to or larger than half a length between the performing position of the folding mechanism portion and the first matching portion.

6. The stapling apparatus according to claim 1, further comprising:
a second paddle, wherein
a position where the second paddle applies sending force to the mediums is between the position where the paddle applies sending force to the mediums and the performing position of the folding mechanism portion.

7. The stapling apparatus according to claim 6, wherein
a distance between the position where the second paddle applies sending force to the mediums and the performing position of the folding mechanism portion is equivalent to or larger than a sum of half a distance between the first matching portion and the position where the paddle applies sending force to the mediums and a distance between the performing position of the folding mechanism portion and the position where the paddle applies sending force to the mediums.

8. The stapling apparatus according to claim 1, wherein
paddles are provided at a plurality of positions different in a direction extending along a holding surface of the holding portion that holds the mediums, and
positions where the paddles apply sending force to the mediums are configured to be different according to the lengths of the mediums in the transport direction by changing positions of the first matching portion according to the lengths of the mediums in the transport direction and by selectively using each paddle at the plurality of positions.

9. The stapling apparatus according to claim 2, wherein
the paddle moves in accordance with a movement of each medium.

10. The stapling apparatus according to claim 1, wherein
the paddle includes a plurality of vanes that rotate about a rotation shaft, and
a radius of a circle formed by trajectories of leading edges of the vanes, the trajectories being formed by a rotation of the rotation shaft, is longer than a distance between an upstream end of the first matching portion on a side opposing a side on which the mediums are stacked and the position where the paddle applies sending force to the mediums.

11. A method of controlling a stapling apparatus that includes a holding portion that receives, stacks, and holds a plurality of mediums transported thereto, a first matching portion positioned downstream of the holding portion in a transport direction, a paddle that applies sending force to the mediums so that leading edge sides of the mediums reach the first matching portion, a stapler that binds the mediums, the leading edge sides of the mediums having been matched by the first matching portion, a folding mechanism portion that folds the mediums that been bound by the stapler, and a control unit that controls the first matching portion and the paddle, the method of controlling the stapling apparatus comprising:
transporting the mediums to a performing position of the stapler and a performing position of the folding mechanism portion by moving the first matching portion; and
differentiating positions where the paddle applies sending force to the mediums according to lengths of the mediums in the transport direction.

12. The method of controlling the stapling apparatus according to claim 11, further comprising:
differentiating the positions where the paddle applies sending force to the mediums according to the lengths of the mediums in the transport direction by moving the paddle.

13. The method of controlling the stapling apparatus according to claim 12, further comprising:
changing the positions of the first matching portion according to the lengths of the mediums in the transport direction.

* * * * *